United States Patent [19]

Matsumoto et al.

[11] Patent Number: 4,752,787

[45] Date of Patent: Jun. 21, 1988

[54] LIQUID JET RECORDING HEAD

[75] Inventors: Haruyuki Matsumoto, Tokyo; Hiroshi Sugitani, Machida; Hiroto Matsuda; Masakazu Ozawa, both of Yokohama; Masami Ikeda, Chiba; Akira Miyagawa, Tanashi, all of Japan

[73] Assignee: Canon Kabushiki Kaisha, Tokyo, Japan

[21] Appl. No.: 8,068

[22] Filed: Jan. 13, 1987

Related U.S. Application Data

[63] Continuation of Ser. No. 737,578, May 24, 1985, which is a continuation of Ser. No. 386,876, Jun. 10, 1982, abandoned.

[30] Foreign Application Priority Data

Jun. 29, 1981 [JP] Japan ..... 56-101029
Jun. 29, 1981 [JP] Japan ..... 56-101030

[51] Int. Cl.[4] ..... G01D 15/18
[52] U.S. Cl. ..... 346/140 R; 346/1.1
[58] Field of Search ..... 346/140 PD, 1.1, 140 R

[56] References Cited

U.S. PATENT DOCUMENTS

| | | | |
|---|---|---|---|
| 4,251,824 | 2/1981 | Hara et al. | 346/140 R |
| 4,284,996 | 8/1981 | Greue | 346/140 PD |
| 4,317,124 | 2/1982 | Shirato et al. | 346/140 PD |
| 4,339,762 | 7/1982 | Shirato et al. | 346/140 PD |
| 4,350,989 | 9/1982 | Sagae et al. | 346/140 PD |
| 4,364,067 | 12/1982 | Koto et al. | 346/140 PD |
| 4,394,670 | 3/1983 | Sugitani et al. | 346/140 R |
| 4,412,224 | 10/1983 | Sugitani | 346/1.1 |
| 4,417,251 | 11/1983 | Sagitani | 346/1.1 |
| 4,437,100 | 3/1984 | Sugitani et al. | 346/1.1 |
| 4,450,455 | 5/1984 | Sugitani et al. | 396/140 R |

FOREIGN PATENT DOCUMENTS

| | | | |
|---|---|---|---|
| 2543452 | 3/1977 | Fed. Rep. of Germany | 346/140 R |
| 0073562 | 6/1980 | Japan | 346/140 PD |
| 0100169 | 7/1980 | Japan | 346/140 R |

*Primary Examiner*—A. D. Pellinen
*Assistant Examiner*—Todd E. DeBoer
*Attorney, Agent, or Firm*—Fitzpatrick, Cella, Harper & Scinto

[57] ABSTRACT

In a liquid jet recording head having a liquid discharging conduit, the ratio of the average cross-sectional area of the conduit at the liquid introducing region to that at the energy actuating region is greater than 1.

9 Claims, 7 Drawing Sheets

LIQUID JET RECORDING HEAD

This application is a continuation of application Ser. No. 737,578 filed May 24, 1985, which was a continuation of appln. of Ser. No. 386,876 filed June 10, 1982 all abandoned.

BACKGROUND OF THE INVENTION

1. Field of the Invention

This invention relates to a liquid jet recording head for generating small droplets of a liquid for recording (hereinafter called as "ink") to be used in a so-called ink jet recording system.

2. Description of the Prior Art

A recording head to be applied to the ink jet recording system is generally provided with a fine ink discharging outlet (sometimes called "orifice"), as an ink pathway and a section for generating ink discharging pressure provided at a portion of said ink pathway.

At the section for generating ink discharging pressure, a driving force for discharging ink is obtained by application of a mechanical pressure or thermal energy to the ink in the region around said section.

In the ink recording system, in order to perform a high speed recording with improved quality of recorded images, it is required that repeated discharging of liquid droplets is carried out stably and continuously for a long time and also the frequency of droplet formation by a recording head (i.e., number of droplets formed per unit time=droplet formation frequency per unit time) as well as stabilization of droplet formation characteristics is improved.

Moreover, it is practically required that such recording heads should easily be designed and manufactured with good production yield.

In the prior art, however, all of these requirements have not yet been satisfactorily fulfilled.

SUMMARY OF THE INVENTION

The present invention has been accomplished in view of these technical tasks, and it is the object of the present invention to provide a liquid jet recording head which is stabilized in continuous liquid droplet formation characteristics over prolonged period of time simultaneously with an improvement in frequency of liquid droplet formation.

According to the present invention, there is provided a liquid jet recording head having a liquid discharging conduit comprising an energy actuating region for imparting discharging force to a liquid, a liquid introducing region from the inlet for said liquid to said energy actuating region, and a liquid discharging region from said energy actuating region to a liquid discharging outlet, characterized in that the average cross-sectional area of the conduit at said energy actuating region, $S_1$, and the average cross-sectional area of the conduit at said liquid introducing region, $S_2$, satisfy the relation, $S_2/S_1>1$.

BRIEF DESCRIPTION OF THE DRAWINGS

FIGS. 7 through 13 each shows a drawing for illustration of an example of the present invention, in which

DETAILED DESCRIPTION OF THE PREFERRED EMBODIMENTS

When a recording head is designed and manufactured in such a manner, the ability of continuous liquid droplet formation over a long period of time can stably be maintained and frequency of liquid droplet formation can also markedly be improved.

According to the present invention, $S_2/S_1$ is greater than 1, preferably $10 \geqq S_2/S_1 > 1$, and more preferably $3 > S_2/S_1 \geqq 1.3$.

Referring now to the accompanying drawings showing preferred embodiments of the present invention, the present invention is to be described in detail below.

Figure 2:
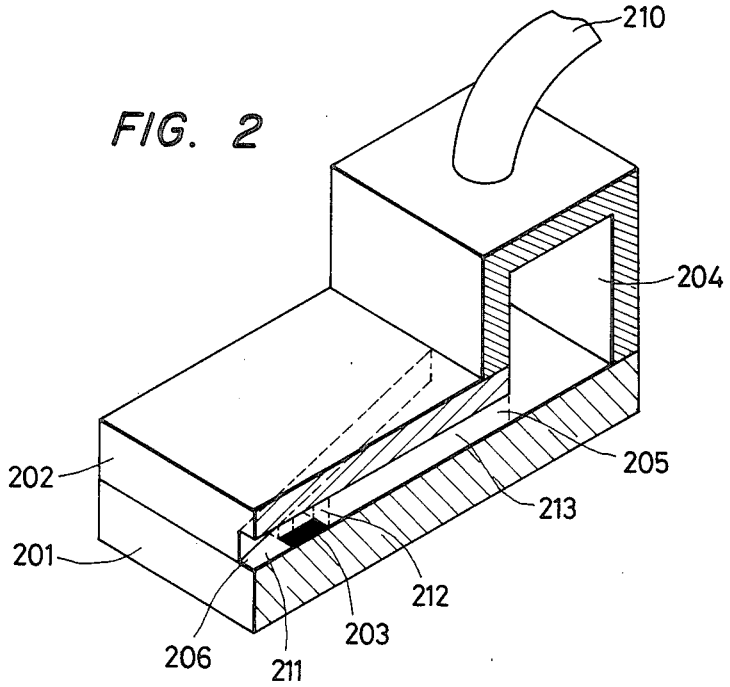
FIGS. 2 through 5 show schematic perspective views partially cut away at the essential part for illustration of preferred embodiments of the recording head according to the present invention, respectively.

In FIG. 2, there is shown a preferred embodiment of the present invention.

Figure 6:
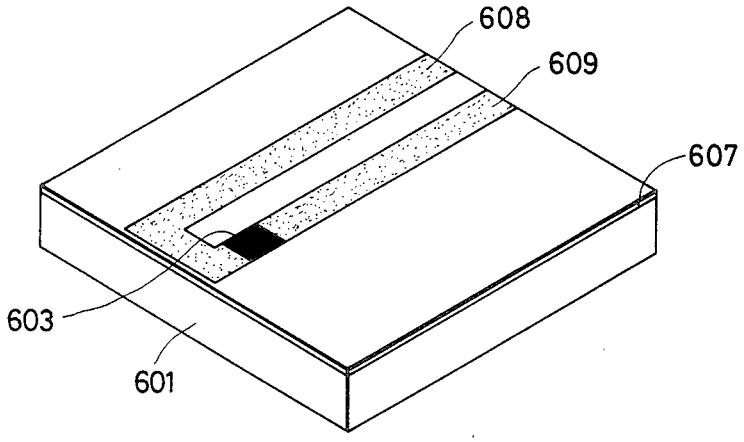
FIG. 6 a schematic perspective view for illustration of the structure of a substrate having a heating element.

Previously as illustrated in FIG. 6, the substrate for mounting a heat energy actuating portion of a recording head was prepared by forming a $SiO_2$ layer 607 of 3 μm thick on a 10 mm×20 mm rectangular alumina substrate 601 of 1 mm thick by sputtering, then sputtering $HfB_2$ as heating element 603 to a thickness of 1000 Å and Al as an electrode to a thickness of 5000 Å, respectively, followed by selective etching to form a heating element 603 with a width of 50 μm and a length of 300 μm and electrodes 608 and 609 with widths of 50 μm, and subsequently applying a $SiO_2$ layer in the thickness of 5000 Å by sputtering.

As the next step, on a substrate 201 similar to that shown in FIG. 6, there was adhered a grooved plate 202 prepared by photoetching of a 1 mm thick photosensitive glass so as to form a groove with a constant depth of 75 μm and a dimension of 75 μm×75 μm at the discharging outlet 206, the groove width being broadened toward the inlet for a liquid 205, so that the groove may cover over the heating element 203, followed by polishing of the end surface. Then, the glass plate was cut to a suitable size, and the glass plate thus cut was in turn adhered to the side of the inlet 205 with an adhesive to form a liquid chamber 204.

In FIG. 2, 211 shows a liquid discharging region, 212 an energy actuating region and 213 a liquid introducing region, these three regions constituting the liquid discharging conduit. As shown in the Figure, an ink supply tube 210 is connected to the liquid chamber 204.

Figure 3:
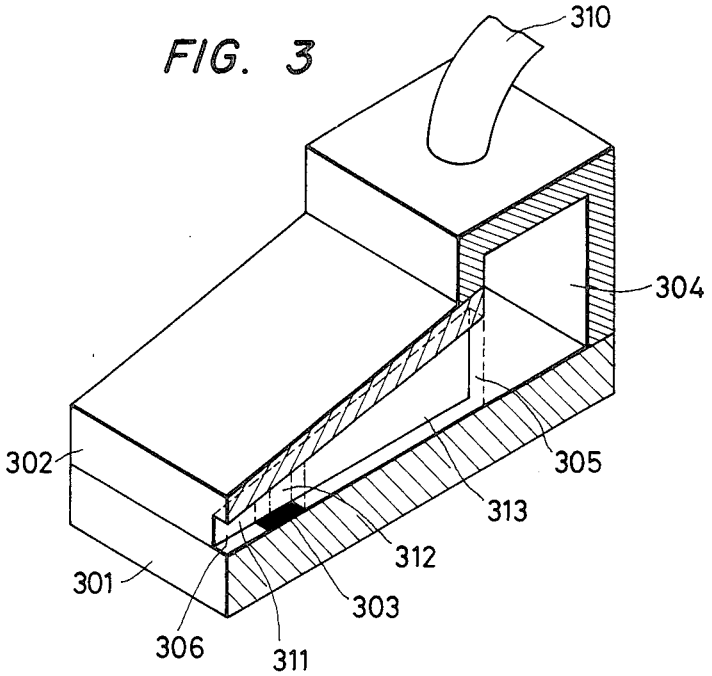

FIG. 3 shows another preferred embodiment of the present invention, in which the substrate and the common liquid chamber are formed in a way similar to FIG. 2, but the liquid discharging portion was formed according to the following method. That is, a glass of a thickness of 2 mm was engraved by means of a diamond cutting grindstone to form a groove of a depth of 1 mm and a width of 75 μm, followed by further grinding to form a groove with a depth tapered shallower toward the orifice side with the groove depth at the orifice portion of 75 μm. The thus formed grooved plate 302 was adhered onto the substrate 301 so as to cover the heating element 303 with the groove, followed by polishing of the end surface, 304 shows a liquid chamber, 305 an inlet for a liquid, 306 a discharging outlet, 310 an ink supply tube, 311 a liquid discharging region, 312 an energy actuating region, and 313 a liquid introducing region.

Figure 1:
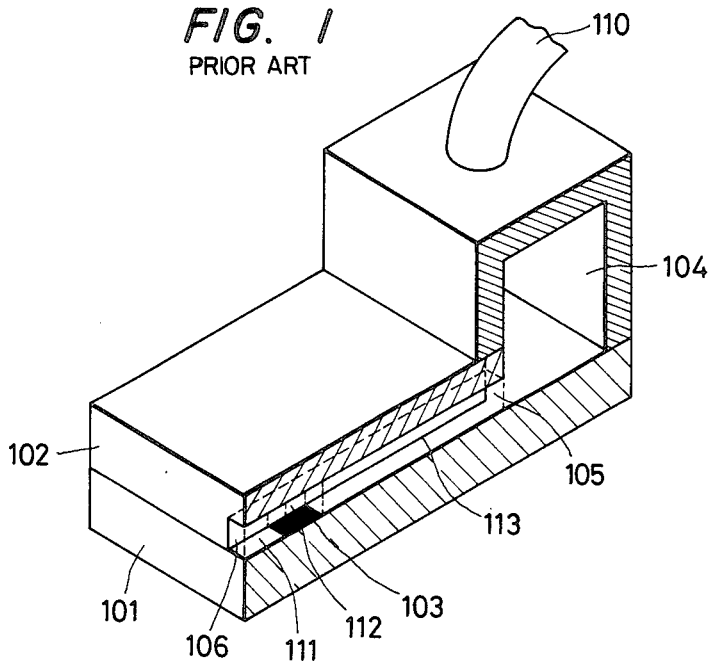
FIG. 1 PRIOR ART
FIG. 1 shows a schematic perspective view partially cut away at the essential part for illustration of an example of the structure of a recording head of the prior art.

FIG. 1 shows an example of a recording head of the prior art, wherein the relation between $S_1$ and $S_2$ is $S_1=S_2$, which may also be prepared according to the method as described in the embodiments as shown in FIGS. 2 and 3. In FIG. 1, 111 shows a liquid discharging region, 112 an energy actuating region, 113 a liquid introducing region, 101 a substrate, 102 a grooved plate, 103 a heating element, 104 a liquid chamber, 105 an inlet for a liquid, 106 a discharging outlet and 110 an ink supply tube. The present inventors have designed and prepared a number of recording heads as described in the above embodiments having various ratios of the average cross-sectional area of the conduit at the liquid introducing region $S_2$ to the average cross-sectional area of the conduit at the energy actuating region $S_1$, namely $S_2/S_1$, and the voltage margin enabling stable liquid droplet formation of $10^7$ pulses or more was measured for each head. As the result, broader voltage margin was obtained with greater $S_2$ relative to $S_1$. On the contrary, discharging was found to be stopped at $3\times10^5$ pulses in case of the head of $S_1=S_2$.

There was also obtained the result that the limit frequency of droplet formation was also higher with greater $S_2$ relative to $S_1$.

The following Table summarizes the data of voltage margin width with stable droplet formation up to $10^6$ pulses at 1 KHz and limit frequencies of droplet formation for the heads with, the structures of $S_2/S_1$ of 1, 1.3, 1.5, 2 and 3, respectively.

| $S_2/S_1$ | Voltage margin width (V) | Limit frequency of droplet formation (KHz) |
|---|---|---|
| 1 | -None (discharging stopped at $3\times10^5$ pulses) | 0.8 |
| 1.3 | 1 | 1 |
| 1.5 | 3 | 1.2 |
| 2 | 8 | 1.8 |
| 3 | 13 | 4.3 |

As described above, according to the present invention, there are great advantages of improved reliability of droplet discharging by an increase in voltage margin width, easier designing of the driving circuit for energy actuating portion as well as miniaturization Further, there is also another advantage of improved limit frequency which enables high speed recording.

In the investigations as described above, as an ink there was employed the following composition which was subjected to filtration with a filter before use:

| | |
|---|---|
| Water | 50 parts |
| Diethylene glycol | 48 parts |
| Black dye | 2 parts |

The heating element had a resistance value of 105 ohm, and liquid droplets were discharged by application of rectangular pulses of 5 μsec (45 V).

Figure 4:
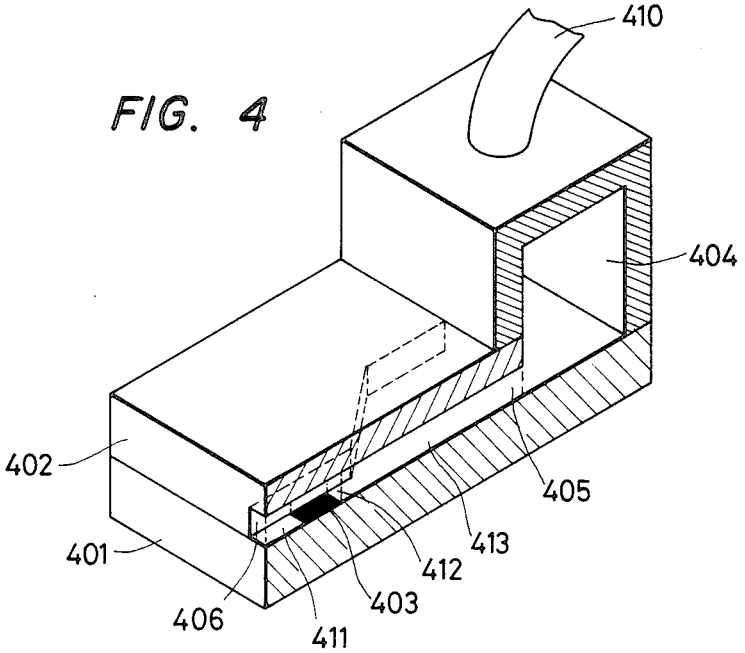
Figure 5:
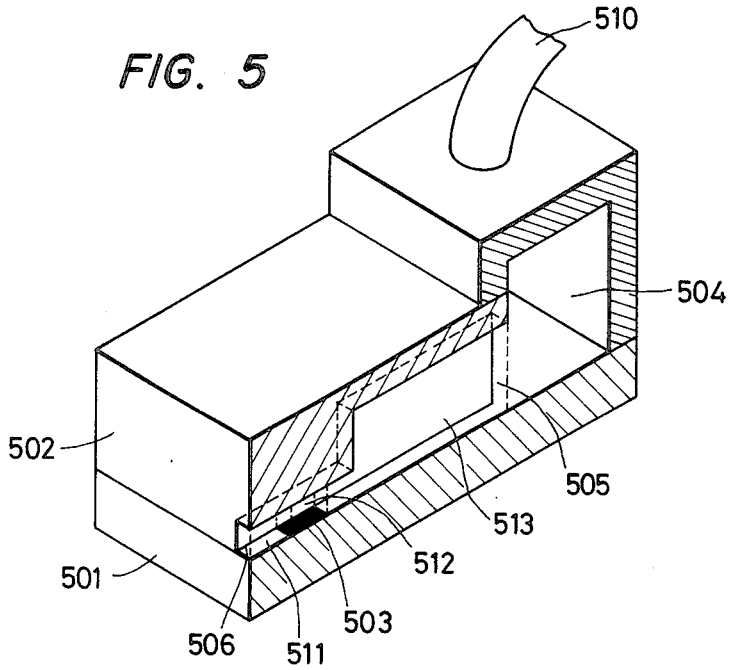

Similarly, FIG. 4 and FIG. 5 show other embodiments of the present invention. Reference numerals in FIGS. 4 and 5 having the same last two numbers as those in FIG. 2 show the same portions as in FIG. 2. In these embodiments, there were also observed entirely the same improvements as in the embodiments shown in FIG. 2 and FIG. 3.

It will be appreciated that in all of the preferred embodiments ink is introduced into the liquid discharging conduit from the liquid chamber by passage through the inlet along a first flow path that is directed generally from the inlet toward the discharging outlet and travels through the liquid introducing region to the energy actuating region along a second flow path generally parallel to the first flow path.

When the recording head is made in accordance with the embodiments shown in FIG. 3 and FIG. 5, it is possible to make a multi-head with a high density of up to 10 lines/mm by formation of a number of discharging portions within the same head, whereby recording of high resolution can be rendered possible, and such a constitution is also greatly advantageous in minituarization of recording heads, together with the benefit of improved droplet formation frequency of the invention.

Further, referring to FIG. 7 through FIG. 14, another embodiment of the present invention will be described below in detail.

FIGS. 7 through 13 show schematic drawings for illustration of one example of the constitution of the liquid jet recording head according to the present invention and preparation procedure thereof.

Figure 7:
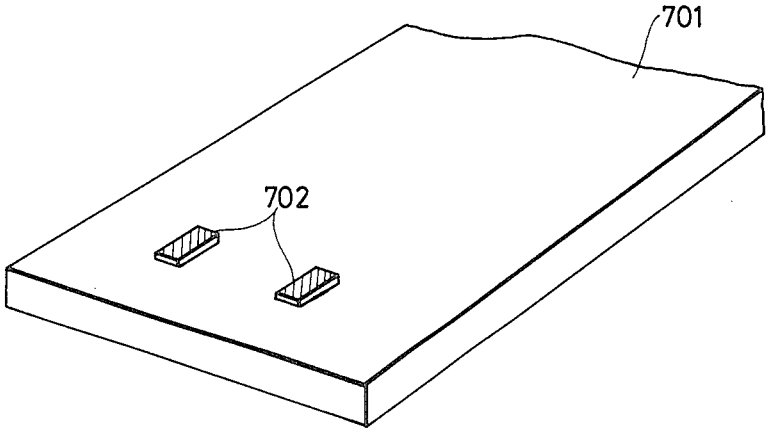
Figure 8A:
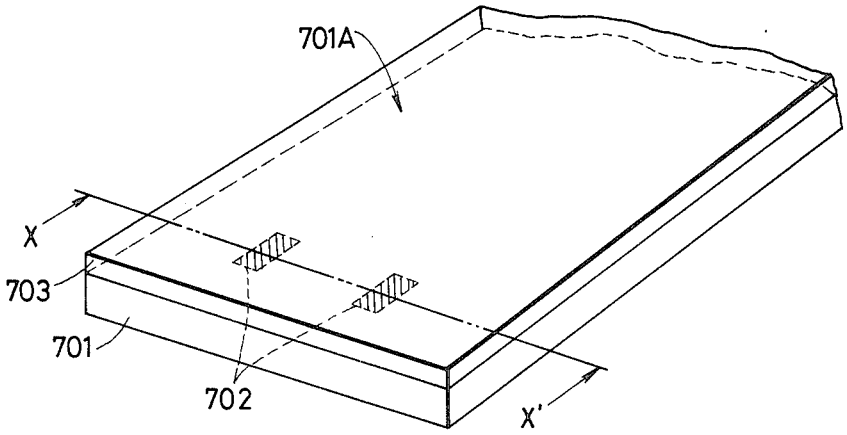
Figure 8B:
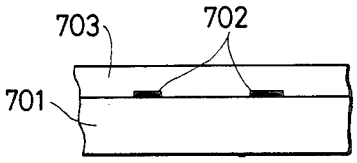
FIG. 8B is a cross-sectional view of FIG. 8A taken along the line X—X' and FIG. 10B a cross-sectional view of FIG. 10A taken along the line Y—Y'.

First, as shown in FIG. 7, on a suitable substrate 701 such as of glass, ceramic, plastic, metal and the like, there are arranged a desired number (two in the Figure) of elements for generating ink discharging pressure 702 such as heating elements or piezoelectric elements. When, for example, a heating element is employed as the aforesaid element for generating ink discharging pressure, such an element will heat the ink in its neighborhood and thereby generate ink discharging pressure. Alternatively, when a piezoelectric element is employed, mechanical vibration of this element will generate ink discharging pressure.

To these elements 702, there are connected electrodes for input of signals (not shown).

Next, the surface of the substrate 701 having the elements for generating ink discharging pressure 702 is cleaned and dried, followed by lamination of a dry film photoresist 703 (film thickness: about 25μ to 100μ) heated to about 80° to 105° C. at a rate of 0.5 to 4 feet/-min. under the condition of pressurization of 1 to 3 kg/cm$^2$ on the substrate surface 701A having the elements 702. (see FIGS. 8A, 8B, wherein 8B is a cross-sectional view taken along X—X' in FIG. 8A) The dry film photoresist 703 is then secured onto the substrate surface 701A under the pressure, and it will never be peeled off from the substrate surface 701A even when external force is applied thereon to some extent.

Figure 9:
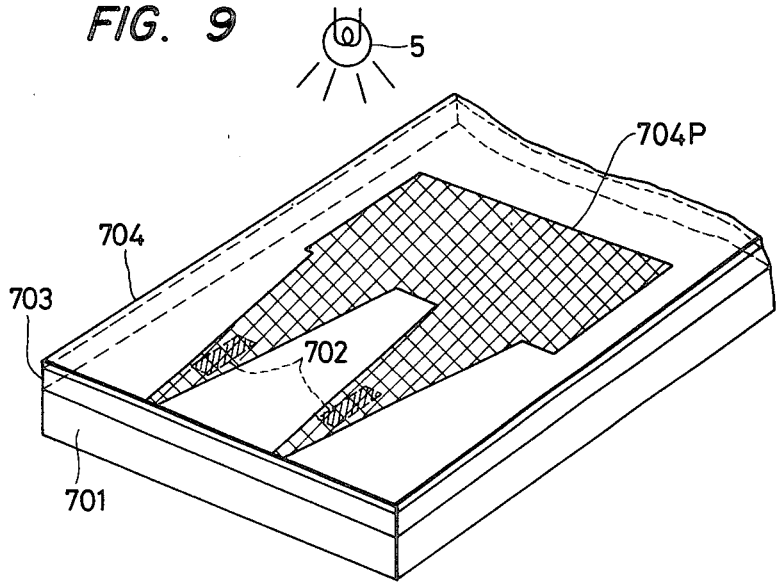

Subsequently, as shown in FIG. 9, on the dry film photoresist 703 provided on the substrate surface, there is superposed a photomask 704 having a desired pattern 704P, and then exposure is effected thereon from the light source 5 above the photomask 704. The above pattern 704P corresponds to the region which will later constitute the ink supplying chamber, the ink discharging conduit and the liquid discharging outlet, and said pattern 704P does not transmit light. Accordingly, the dry film photoresist 703 at the region covered by the pattern 704P is not exposed to light. Upon this operation, it is also necessary to effect registration between the set position of the element for generating ink discharging pressure 702 and that of the above pattern 704P according to a conventional manner. In short, it is at least necessary to arrange carefully so that the above element 702 may be positioned within the ink discharging conduit formed afterwards. When exposed as described above, the photoresist 703 outside the region of the pattern 704P undergoes polymerization reaction to be hardened and become solvent insoluble. On the other hand, the photoresist 703 not exposed is not hardened, but remains as solvent soluble.

Accordingly, depending on the shape of the pattern 704P, the unhardened region in the photoresist 703 can freely be changed.

Figure 10A:
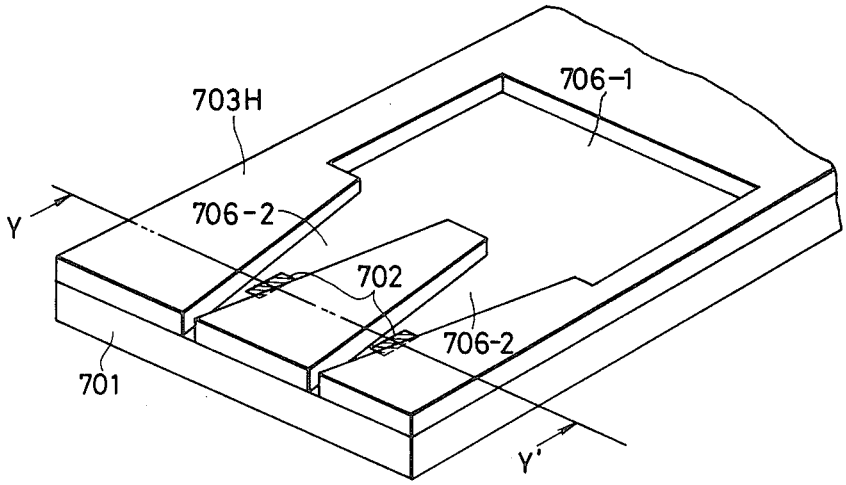

After the exposure procedure, the dry film photoresist 703 may be immersed in a volatile organic solvent such as trichloroethane to dissolve away the unpolymerized (unhardened) photoresist, whereby a recess portion as shown in FIG. 10A corresponding to the pattern 704P is formed on the hardened photoresist film 703 (FIG. 10A). Then, for the purpose of improving solvent resistance of the hardened photoresist film 703H remaining on the substrate 701, it is further subjected to hardening. Such a hardening may be preferably effected by thermal polymerization (by heating at 130° to 160° C. for 10 to 60 minutes) or by irradiation of ultra-violet radiation, or by use of a combination of these methods.

Figure 10B:
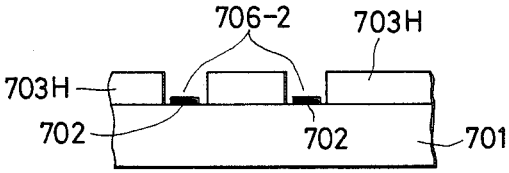

Of the recess portions thus formed on the hardened photoresist film 703H, 706-1 corresponds to the ink supplying chamber in the finished ink jet head, while 706-2 to the ink discharging conduit. It should be noted that FIG. 10B is a cross-sectional view of FIG. 10A taken along the Y—Y'.

Figure 11:
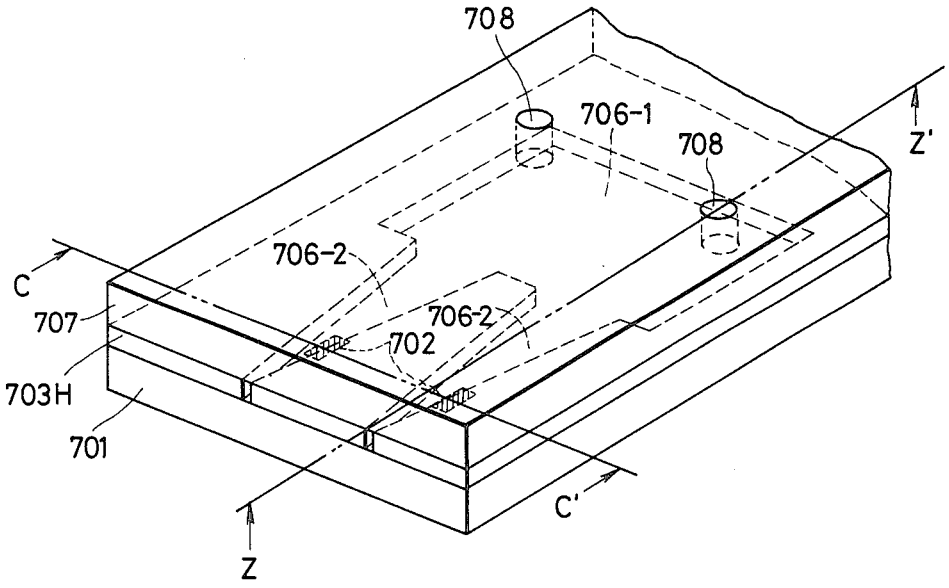

After the groove walls for the ink supply chamber 706-1, the ink discharging conduit 706-2 and the like on the substrate 701 according to the above procedure, are formed a flat plate 707 constituting a ceiling is then adhered to the upper surface of said substrate, as shown in FIG. 11. Such adhering may be effected according to the following methods:

(1) A flat plate of glass, ceramics, metal, plastics or the like is subjected to a spinner coating with an epoxy type adhesive in the thickness of 3 to 4$\mu$, followed by pre-heating to convert the adhesive to so called B-stage, which is in turn laminated on the hardened photoresist film 703H and thereafter the aforesaid adhesive is subjected to full hardening; or (2) A flat plate of a thermoplastic resin such as an acrylic resin, an ABS resin, a polyethylene and the like is fused by heating and directly adhered onto the hardened photoresist film 703H.

As shown in the Figures, the flat plate 707 is provided with a thru-hole 708 for connection to the ink supply tube (not shown). After the bonding between the substrate having grooves and the flat plate as described above has been completed, the assembly is cut along the line C—C'. This is done for optimization of the interval between the element for generating ink discharging pressure 702 and the like discharging outlet 709 (FIG. 12) in the ink discharging conduit 706-2. The region to be cut away may be suitably determined. In performing this cutting, there may be employed the dicing method which has been conventionally used in semiconductors industries.

Figure 12:
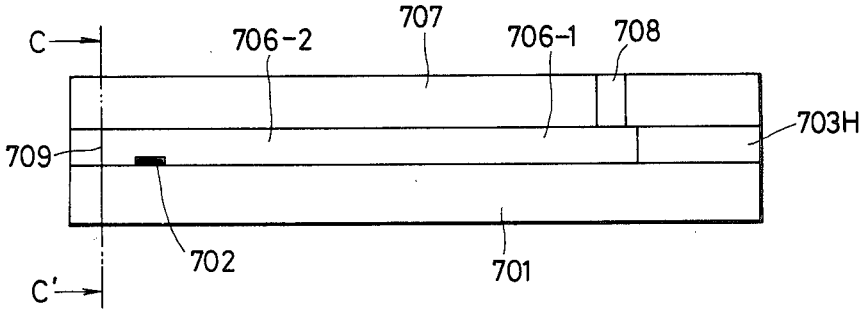

FIG. 12 shows a cross-sectional view of FIG. 11 taken along the line Z—Z'.

Figure 13:
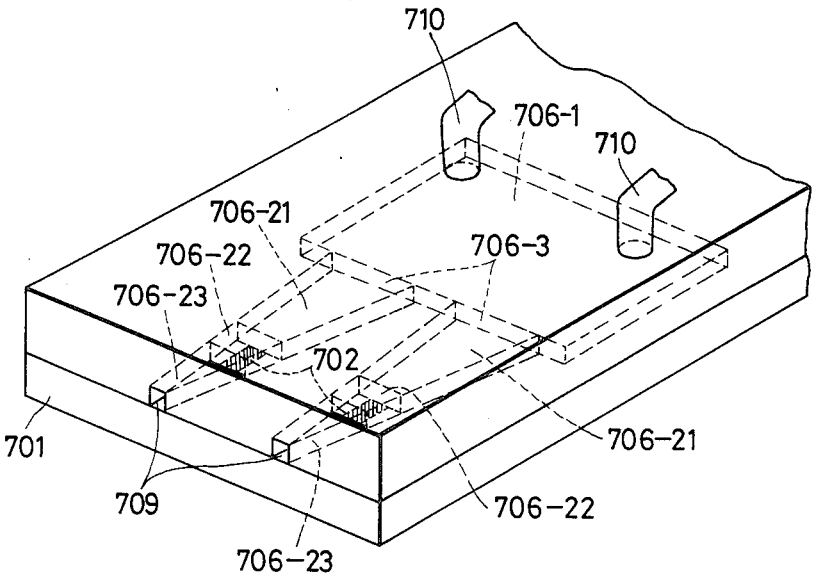

The cut surface is made smooth by polishing and an ink supply tube 710 (FIG. 13) is fitted to the thru-hole 708 (FIGS. 11 and 12) to provide a finished ink jet head (FIG. 13).

In the Examples as described above, as a photosensitive composition for preparation of the groove (photoresist), there was employed a dry film type, namely a solid composition. But, the photoresist is not limited to such a type, but it is also of course be possible to utilize a liquid photosensitive composition. As the method for formation of a coated film of the photosensitive composition on a substrate, there may be employed, in case of a liquid photosensitive composition, the method by means of squeegee as employed in preparation of a relief image. That is, walls of the same height as the desired film thickness of the photosensitive composition are placed around the substrate, and excessive composition is removed by squeegee. In this case, the photosensitive composition employed may have a viscosity suitably in the range of from 100 cp to 300 cp. It is also necessary to determine the height of walls to be placed around the substrate taking into consideration the loss of weight of the solvent in the photosensitive composition through vaporization.

On the other hand, in case of a solid composition, a photosensitive composition sheet is laminated on a substrate by pressure adhesion under heating.

In the present invention, for convenience in handling as well as easy and precise control of the thickness, it is advantageous to employ a solid film type composition. As such a solid composition, there may be included commercially available photosensitive resins sold under the trade names of Permanent Photopolymer Coating RISTON, Solder Mask 730S, 740S, 730FR, 740FR and SM1, produced by E.I. Du Pont de Nemours & Corporation. In addition, as photosensitive compositions used in the present invention, there may be also included a great number of photosensitive materials such as photosensitive resins, photoresists, and the like which are conventionally used in the field of photolithography. Examples of these photosensitive materials are diazo resin, p-diazoquinone, photopolymerization type photopolymer using vinyl monomer and polymerization initiator, dimerization type photopolymer using polyvinyl cinnamate and a sensitizer, mixtures of o-napthoquinonediazide and novolac type phenolic resin, mixtures of polyvinyl alcohol and dizao resin, polyether type photopolymer prepared by copolymerization of 4-glycidylethyleneoxide with benzophenone or glycidylchalcone, copolymer of N,N-dimethylmethacrylamide with, for example, acrylamide benzophenone, unsaturated polyester type photosensitive resin (e.g. APR produced by Asahi Kasei K.K., Tebista produced by Teijin K.K., Sonne produced by Kansai Paint K.K.), unsaturated urethane oligomer type photosensitive resin, photosensitive composition comprising a mixture of bifunctional acrylmonomer, a photopolymerization initiator and a polymer, bichromate type photoresist, non-chromium type water-soluble photoresist, polyvinyl cinnamate type photoresist, cyclized rubber-azide type photoresist, and so on.

In the finished head (FIG. 13), 706-3 shows the ink inlet into an ink discharging conduit, 706-21 the ink introducing region in the ink discharging conduit, 706-22 the energy actuating region and 706-23 the ink discharging region. With respect to other reference numerals in FIG. 13, like numerals indicate like portions in FIGS. 13, 11 and 12.

The present inventors have designed and prepared a number of recording heads as described in the above embodiments having various ratios of the average cross-sectional area of the conduit at the liquid introducing region, $S_2$, to the average cross-sectional area of the conduit at the energy actuating region, $S_1$, namely $S_2/S_1$, and the voltage margin enabling stable liquid droplet formation of $10^7$ pulses or more was measured for each head. As the result, broader voltage margin was obtained with greater $S_2$ relative to $S_1$, but discharging was found to be stopped at $3\times10^5$ pulses in case of the head of $S_1=S_2$.

There was also obtained the result that the limit frequency of droplet formation was also higher with greater $S_2$ relative to $S_1$.

The following Table summarizes the data of voltage margin width with stable ink droplet formation up to $10^6$ pulses at 1 KHz and limit frequencies of droplet formation for the heads with the structures of $S_2/S_1$ of 1, 1.3, 1.5, 2 and 3, respectively.

| $S_2/S_1$ | Voltage margin width (V) | Limit frequency of droplet formation (KHz) |
|---|---|---|
| 1 | None (discharging stopped at $3\times10^5$ pulses) | 0.8 |
| 1.3 | 1 | 1 |
| 1.5 | 3 | 1.2 |
| 2 | 8 | 1.8 |
| 3 | 13 | 4.3 |

As described above, according to the present invention, there are great advantages of improved reliability of droplet discharging by an increase of voltage margin width, easier designing of the driving circuit for energy actuating portion as well as minituarization. Further, there is also another advantage of improved limit frequency which enables high speed recording.

In the investigations as described above, there was employed, as an ink, the following composition which was subjected to filtration with a filter before use:

| | |
|---|---|
| Water | 50 parts |
| Diethylene glycol | 48 parts |
| Black dye | 2 parts |

The resistance heating element used as the element for generating ink discharging pressure had a resistance value of 150 ohm, and liquid droplets were discharged by application of rectangular pulses of 5 μsec (45 V).

Figure 14:
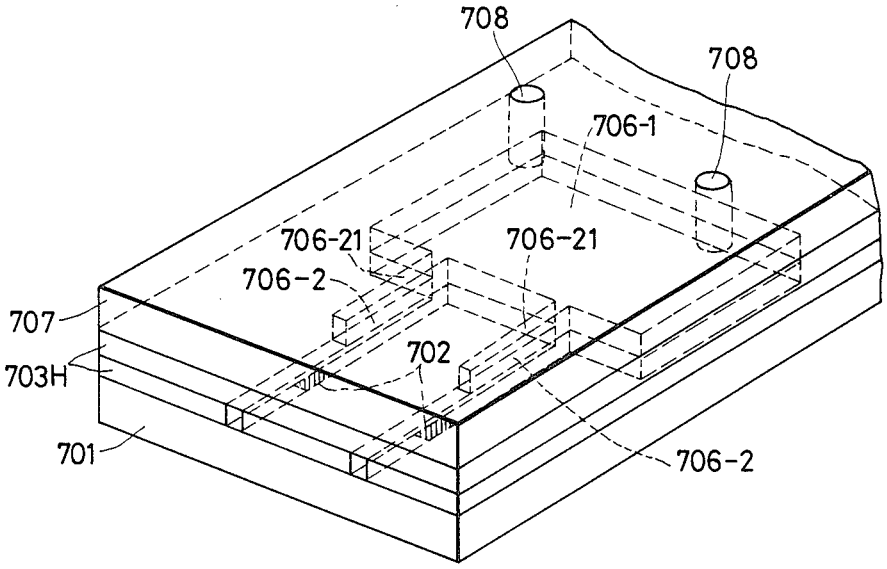
FIG. 14 is a schematic perspective view for illustration of another embodiment of the present invention.

Referring now to FIG. 14, another embodiment of the present invention is to be described below.

In the Example as shown in FIG. 14 as one form in which the ratio of the average cross-sectional area of the conduit at the ink introducing region, $S_2$, to the average cross-sectional area of the conduit at the energy actuating region, $S_1$, i.e. $S_2/S_1$, is greater than 1, the cross-sectional area of the ink introducing region 760-21 is enlarged in the ink discharging conduit 706-2 in the direction approximately perpendicular to the substrate 701. As to other reference numerals in FIG. 14, like numerals indicate like portions in FIGS. 14, 11 and 12. As the method for such an enlargement, the steps from the lamination step of the dry film photoresist to the step of dissolving away the unpolymerized (unhardened) photoresist by immersion in trichloroethane as described above in the above Examples may be repeated twice or more while changing suitably the pattern. By making such a head form as illustrated in this Figure, there can be manufactured, to a great advantage, multi-recording heads having ink discharging orifices arranged at a high density of up to 10 lines/mm.

Benefits of the preparation of the recording heads as illustrated by referring to Examples in FIGS. 7 through 14, there may be enumerated the following advantages:

1. Since the primary step of preparation of the head relies on so-called photolithographic technique, formation of minute portions of head can be very simply effected with a desired pattern. Further, by formation of multi-layers of photosensitive composition layers, it is rendered possible to prepare a head in which the cross-sectional area of the ink discharging orifice is changed in the direction substantially perpendicular to the substrate. Further, it is also possible to work a number of heads with the same constitution at the same time.

2. Relatively small number of the preparation steps results in good productivity.

3. Registration of the principal constitutional parts can be done easily and surely, whereby heads with a high dimensional precision can be obtained in good yield.

4. A high density multi-array head can be obtained by a simple method.

5. The thickness of the groove wall constituting the ink pathway can be very easily controlled, and therefore, it is possible to form ink pathways with desired dimensions (e.g. groove depths) depending upon the thickness of the photosensitive (resin) composition layer employed.

6. Continuous and bulk production is possible.

7. Since no etchant (e.g. strong acids such as hydrogen fluoride and the like) is necessary, the process is also excellent in safety and hygiene.

8. Substantially no adhesive is required, and therefore, there is no trouble such as clogging the groove by flowing of the adhesive or adhesion of the adhesive to the ink discharging, pressure generating element, to cause a lowering of function of the head.

What we claim is:

1. A liquid jet recording head having a liquid chamber and a liquid discharging conduit with an inlet in direct communication with said liquid chamber for introducing liquid into said liquid discharging conduit along a first flow path, said liquid discharging conduit comprising an energy actuating region for imparting discharging force to a liquid, a liquid introducing region for introducing liquid from said inlet at the liquid chamber side of said conduit to said energy actuating region along the second flow path generally parallel to the first flow path, and a liquid discharging region between said energy actuating region and a liquid discharging outlet, wherein the average cross-sectional area of the conduit decreases substantially monotonically from said inlet to said outlet.

2. A liquid jet recording head according to claim 1, wherein the average cross-sectional area of the conduit at said energy actuating region, $S_1$, and the average cross-sectional area of the conduit at said liquid introducing region, $S_2$, satisfy the relation, $S_2/S_1 \geqq 1.3$.

3. A liquid jet recording head according to claim 1, wherein said energy actuating region has a heating element arranged therein.

4. A liquid jet recording head according to claim 2, wherein $S_2/S_1$ defines a value (x) which satisfies the following numerical formula:

$$10 \geqq x \geqq 1.3.$$

5. A liquid jet recording head according to claim 2, wherein a plurality of the liquid discharging conduits are provided.

6. A liquid jet recording head according to claim 1, wherein said liquid discharging conduit comprises a wall formed of a hardened film of photosensitive resin provided on a surface of a substrate and a liquid chamber, and wherein the average cross-sectional area of the conduit at said energy actuating region, $S_1$, and the average cross-sectional area of the conduit at said liquid introducing region, $S_2$, satisfy the relation $S_2/S_1 \geqq 1.3$.

7. A liquid jet recording head according to claim 1, wherein said liquid discharging conduit comprises a wall formed of a hardened film of dry film photoresist provided on a surface of substrate and a liquid chamber, and wherein the average cross-sectional area of the conduit at said energy actuating region, $S_1$, and the average cross-sectional area of the conduit at said liquid introducing region, $S_2$, satisfy the relation $S_2/S_1 \geqq 1.3$.

8. A liquid jet recording head according to claim 1, wherein the average cross-sectional area of said conduit decreases with at least one step-decrease and without substantial increase, from said inlet to said outlet.

9. A liquid jet recording head according to claim 1, wherein the average cross-sectional area of the conduit decreases continuously from a point intermediate said inlet and said energy actuating region to a point intermediate said energy actuating region and said outlet.

* * * * *

UNITED STATES PATENT AND TRADEMARK OFFICE

CERTIFICATE OF CORRECTION

PATENT NO. : 4,752,787

DATED : June 21, 1988

INVENTOR(S) : HARUYUKI MATSUMOTO, ET AL.

It is certified that error appears in the above-identified patent and that said Letters Patent is hereby corrected as shown below:

AT [56] IN REFERENCES CITED

U.S. Patent Documents, "Sagitani" should read --Sugitani--.
Foreign Patent Documents, insert --2548928 Fed. Rep. of Germany 5/76 --.

COLUMN 2

Line 1, "FIG. 6 a" should read --FIG. 6 is a--.
Line 20, "$3>S_2/S_1\geq 1.3$." should read --$3\geq S_2/S_1\geq 1.3$.--.
Line 68, "surface," should read --surface.--.

COLUMN 3

Line 32, "with," should read --with--.

COLUMN 4

Line 17, "minituariza-" should read --miniaturiza- --.

COLUMN 5

Line 34, "formed a" should read --formed, a--.

COLUMN 6

Line 5, "be" should be deleted.
Line 43, "dizao" should read --diazo--.

UNITED STATES PATENT AND TRADEMARK OFFICE

CERTIFICATE OF CORRECTION

PATENT NO. : 4,752,787

DATED : June 21, 1988

INVENTOR(S) : HARUYUKI MATSUMOTO, ET AL.

It is certified that error appears in the above-identified patent and that said Letters Patent is hereby corrected as shown below:

COLUMN 7

Line 31, "minituarization." should read --miniaturization.--.

COLUMN 8

Line 1, "Benefits" should read --As benefits--.
Line 36, "discharging," should read --discharging--.
Line 48, "the second flow path" should read --a second flow path--.

COLUMN 9

Line 15, "of substrate" should read --of a substrate--.

Signed and Sealed this

Fourteenth Day of March, 1989

*Attest:*

*Attesting Officer*

DONALD J. QUIGG

*Commissioner of Patents and Trademarks*